US006866436B2

(12) United States Patent
Kanari et al.

(10) Patent No.: US 6,866,436 B2
(45) Date of Patent: Mar. 15, 2005

(54) WRITING INSTRUMENT

(75) Inventors: Hiroyuki Kanari, Fukushima-ken (JP); Yousuke Ishii, Koriyama (JP)

(73) Assignee: Micro Co., Ltd., Tokyo (JP)

( * ) Notice: Subject to any disclaimer, the term of this patent is extended or adjusted under 35 U.S.C. 154(b) by 0 days.

(21) Appl. No.: 10/612,564

(22) Filed: Jul. 2, 2003

(65) Prior Publication Data

US 2004/0028453 A1 Feb. 12, 2004

(30) Foreign Application Priority Data

Jul. 25, 2002 (JP) ..... 2002-216581
Nov. 20, 2002 (JP) ..... 2002-336246

(51) Int. Cl.[7] ..... B43K 24/02; B43K 5/16; B43K 7/12

(52) U.S. Cl. ..... 401/108; 401/115; 401/117

(58) Field of Search ..... 401/108, 107, 401/115, 117, 99

(56) References Cited

U.S. PATENT DOCUMENTS 1,717,731 A * 6/1929 Nikonow ..... 401/108 X
4,479,732 A * 10/1984 Shimizu ..... 401/107
4,575,271 A * 3/1986 Hashimoto et al. ..... 401/107
5,184,908 A * 2/1993 Yamamoto et al. ..... 401/99 X

* cited by examiner

*Primary Examiner*—Gregory L. Huson
*Assistant Examiner*—Kathleen J. Prunner
(74) *Attorney, Agent, or Firm*—Adams & Wilks

(57) ABSTRACT

A writing instrument has a tubular member having a longitudinal axis and an aperture at an end thereof. A writing component is mounted in the tubular member and has a writing tip at an end portion thereof. The tubular member and the writing component are movable relative to one another in an axial direction along the longitudinal axis of the tubular member between a writing position at which the writing tip protrudes from the aperture of the tubular member and a housed position at which the writing tip is disposed in the tubular member. An airtight sleeve is connected to the end portion of the writing component for movement between an advanced position and a retracted position. The airtight sleeve has a bore through which the end portion of the writing component passes during movement of the writing component between the writing position and the housed position.

19 Claims, 12 Drawing Sheets

WRITING INSTRUMENT

BACKGROUND OF THE INVENTION

1. Field of the Invention

The present invention relates generally to writing instruments and, more specifically, to a writing instrument having a writing component containing volatile writing constituents, such as a marker, a water-based ink pen, a water-based ball point pen, a correction pen and a highlighter pen. The present invention also relates to a writing instrument in which a writing tip of the writing component can be maintained in an airtight condition when it is not used.

2. Background Information

In conventional writing instruments, such as a marker, a writing tip is maintained in an airtight condition so that it will not be dried when it is not used. Usually, in the case of a cap-type writing instrument, a cap is detachably attached to the front end of a barrel housing a writing component, and an airtight chamber surrounding the writing tip is formed by attaching the cap. In some cases, a soft material such as a rubber piece is provided in the cap so that it will abut on the writing tip. Further, in a case of a capless-type writing instrument, an airtight structure has been known wherein an airtight chamber surrounding the writing tip is disposed at the front portion of a barrel, in which the front end opening portion of the airtight chamber is opened and closed by a biasing member such as a spring so that the airtight chamber is opened when a writing component (e.g., a refill) advances and the airtight chamber is closed when the writing component retracts.

However, use of the conventional cap-type writing instrument requires the cumbersome step of removing the cap prior to a writing operation. In the case of the conventional capless-type writing instrument, since a spring is needed to open and close the opening portion, the number of parts becomes large, the manufacture and assembly thereof is complicated and expensive, and the resulting writing instrument tends to have a large diameter.

Moreover, conventional writing instruments having an airtight structure for the writing component are available. One such writing instrument has a rotating cam-type feeding mechanism disposed in a barrel for moving the writing component forward and backward. In general, such a rotating cam-type feeding mechanism is disposed in a rear portion of the barrel and has a rotational cam which abuts on a rear end of a writing component, a guide cam which allows the rotational cam to transfer in an axial direction, and an outer cam which is formed on an inner side of the barrel and guides the transfer of the rotational cam. However, the conventional rotating cam-type feeding mechanism is associated with a large number of parts and its manufacture and assembly is complicated. Furthermore, since a feeding mechanism is provided at the rear portion of the barrel, the entire length of the writing instrument tends to be long. Any attempt to form the conventional rotating cam-type feeding mechanism with a compact structure will require the use of an undesirable short writing component. Accordingly, if an airtight structure for maintaining the writing tip in an airtight manner is disposed at the front portion of the barrel, the entire length of the writing component is increased.

SUMMARY OF THE INVENTION

The present invention is directed to a writing instrument which overcomes the foregoing drawbacks of the conventional art.

It is an object of the present invention to provide a writing instrument for which it is not necessary to detach a cap when it is used, and in which by an operation of shifting a barrel or a writing component in an axial direction, the writing tip of the writing component can be protruded or the writing tip can be maintained in an airtight manner.

It is another object of the present invention to provide a writing instrument having an airtight structure for which no spring is needed for the airtight mechanism, thereby reducing the number of parts.

It is a further object of the present invention to provide a writing instrument having an airtight mechanism in which the writing component can be moved by a rotating cam-type feeding mechanism and which can accommodate a long writing component.

It is still another object of the present invention to provide a writing instrument which has a simple and compact structure with a small number of parts and which is economical to manufacture.

The foregoing and other objects of the present invention are carried out by a writing instrument comprising a cylindrical barrel having an aperture at its front end and a writing component housed in the barrel and having a writing tip and a shoulder located behind the writing tip. The barrel and the writing component are relatively movable in an axial direction of the barrel between a writing position at which the writing tip protrudes from the aperture and a housed position at which the writing tip is housed inside the barrel. An airtight sleeve is fitted on the front portion of the writing component in such a manner that the airtight sleeve is movable between an advanced position and a retracted position. The airtight sleeve has, at a front portion thereof, a bore through which the front portion of the writing component passes. An inner raised portion is formed in the airtight sleeve so that when the airtight sleeve is located at the retracted position, the inner raised portion contacts the shoulder of the writing component in an airtight manner. The contact between the inner raised portion of the airtight sleeve and the shoulder of the writing component is disengageable when the airtight sleeve stops at the advanced position.

A cap plate is pivotally fitted on the airtight sleeve so that the bore of the airtight sleeve may be opened or closed. A projecting rib is disposed at a rear side of the cap plate so that when the airtight sleeve moves from the advanced position to the retracted position, the projecting rib abuts on an inner side of the barrel so as to rotate the cap plate in such a direction that the cap plate is pressed against the bore and closes the bore. The barrel has a window hole into which the projecting rib enters when the airtight sleeve moves from the retracted position to the advanced position so as to allow the rotational movement of the cap plate to open the bore of the airtight sleeve.

The writing instrument of the present invention may be constructed so that the barrel is moved relative to the writing component or the writing component is moved relative to the barrel. According to the present invention, when the writing component is moved by a rotating-cam type feeding mechanism, a writing instrument having the rotating-cam type feeding mechanism and the airtight sleeve in the forward portion of the barrel is provided. The rotating cam-type feeding mechanism comprises a rotational cam connected to the writing component for undergoing rotational movement and axial movement in the axial direction, an outer cam having a cam groove for guiding movement of the rotational cam in the axial direction, and a guide cam connected to a rear end of the front piece of the tubular body and having a cam element for rotating the rotational cam.

When the barrel or the writing component moves from the housed position to the writing position, the airtight sleeve moves together toward the advanced position in such a state that the inner raised portion of the airtight sleeve contacts the shoulder of the writing component. At the advanced position of the airtight sleeve, the contact between the shoulder of the writing component and the inner raised portion of the airtight sleeve is disengaged. When the projecting rib confronts the window hole of the barrel, the projecting rib enters into the window hole and, at the same time, the cap plate is opened and the writing tip of the writing component protrudes from the aperture of the barrel. In this state, the writing instrument can be used for writing.

When the barrel or the writing component moves from the writing position toward the housed position, the inner raised portion of the airtight sleeve contacts the shoulder of the writing component. The airtight sleeve then moves together with the writing component toward the retracted position, the cap plate is pressingly fitted to the bore by the projecting rib, the bore of the airtight sleeve is closed, and the periphery of the writing tip is airtightly surrounded, thereby preventing drying of the writing tip.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangements and instrumentalities shown. In the drawings:

FIG. 14(A) shows when the writing component is located at a housed position, FIG. 14(B) shows when the airtight sleeve moves to an advanced position, and FIG. 14(C) shows when a cap plate is opened; FIG. 15(A) shows a state in which the writing tip protrudes a little from an aperture, FIG. 15(B) shows a state in which the writing tip protrudes more from the aperture, and FIG. 15(C) shows a state in which the writing component is held at a writing position.

DETAILED DESCRIPTION OF THE PREFERRED EMBODIMENTS

Figure 1:
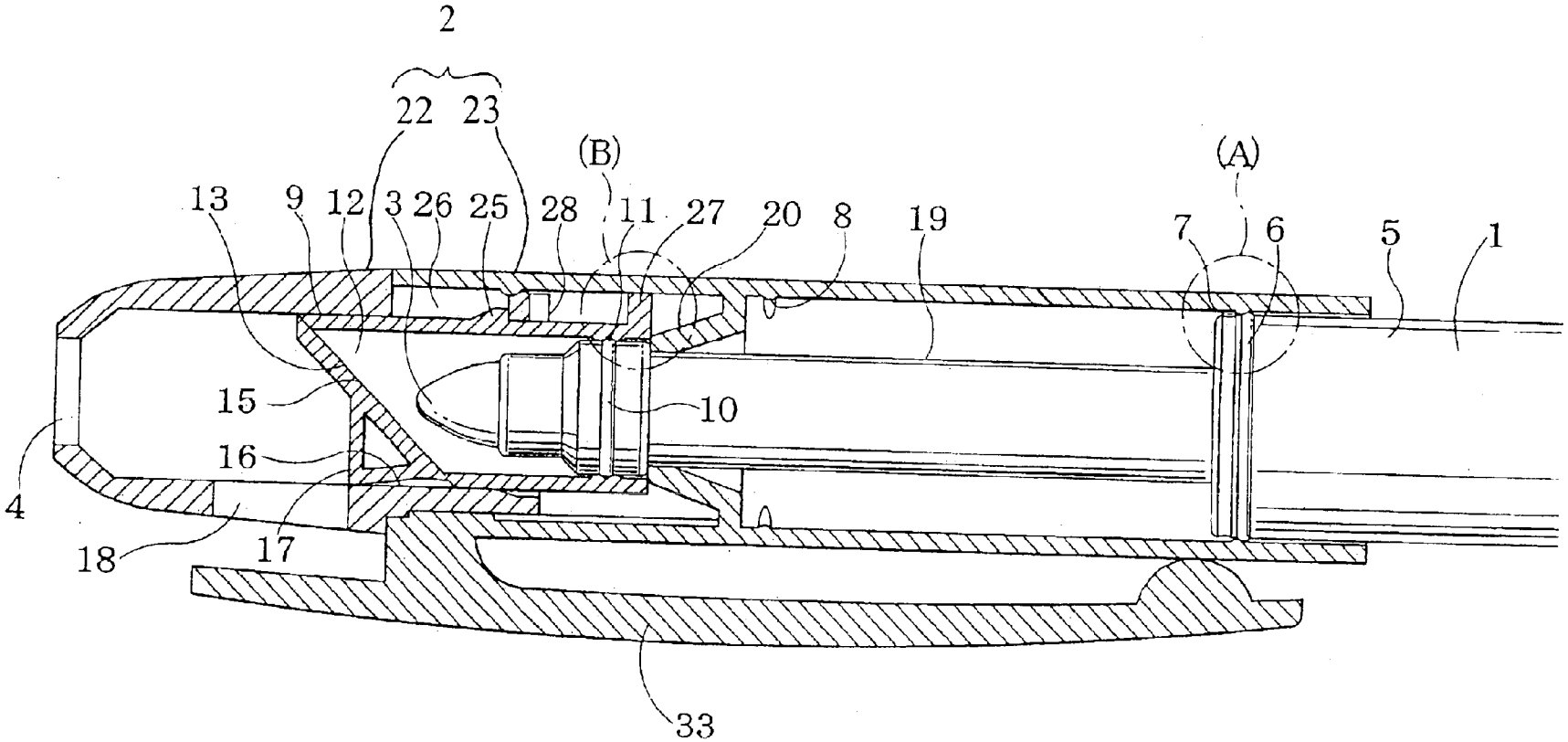
FIG. 1 is a partial cross-sectional view of a writing instrument according to an embodiment of the present invention in which the writing component is shown in a housed position.

While this invention is susceptible of embodiments in many different forms, this specification and the accompanying drawings disclose only some forms as examples of the use of the invention. The invention is not intended to be limited to the embodiments so described, and the scope of the invention will be pointed out in the appended claims.

The writing instrument of the present invention has a cylindrical barrel having an aperture at its front end and a writing component housed in the barrel. The writing component contains volatile writing constituents, such as a marker, a water-based ink pen, a water-based ball point pen, a correction pen and a highlighter pen, and has a writing tip at its front end. The barrel and the writing component are relatively movable in an axial direction of the barrel between a writing position, where the writing tip protrudes outwardly from the aperture, and a housed position, where the writing tip is housed inside the barrel.

Referring now to the drawings in detail, FIGS. 1–7 show a writing instrument according to a first embodiment of the present invention. As described in detail below, in the embodiment shown in FIGS. 1–7 a tubular member in the form of a generally cylindrical barrel 2 is movable in an axial direction relative to a writing component 1.

Figure 2:
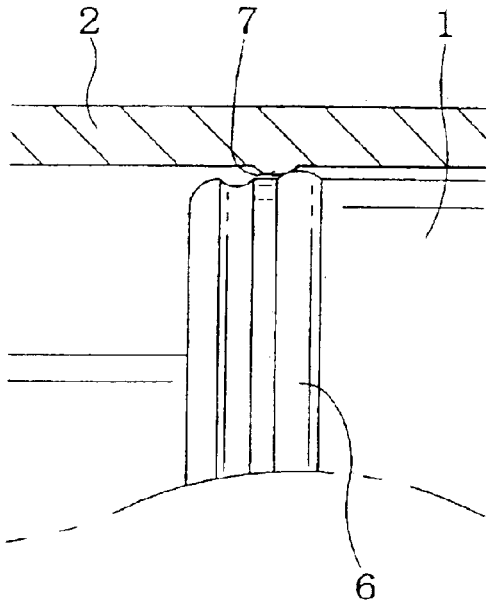
FIGS. 2(A) and 2(B) show enlarged explanatory views of part (A) and part (B), respectively, in FIG. 1.
Figure 2:
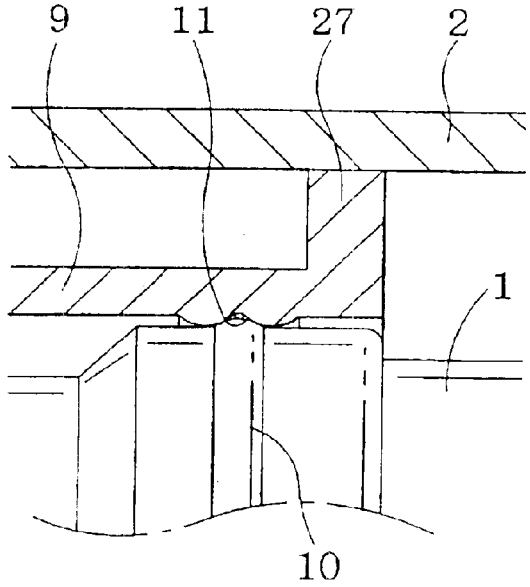

With reference to FIGS. 1–2, the barrel 2, which is a generally cap-shaped tubular member in this embodiment, extends in an axial direction alone a longitudinal axis thereof and is attached to a forward end portion of the writing component 1 (e.g., a refill). The barrel 2 is preferably made of a plastic material and moves between a housed position (FIG. 1), where a writing tip 3 of the writing component 1 is housed inside the barrel, and a writing position (FIG. 6 as further described below), where the writing tip 3 protrudes from an aperture 4 formed at the front end of the barrel 2. In this embodiment, the barrel 2 can be slidingly moved in an axial direction of the writing component 1. The barrel may be constructed so that, for example, it moves in an axial direction in a spiral movement by screw coupling the barrel to the writing component (not shown).

On the outer periphery of a large diameter portion 5 of the writing component 1, a lock portion 6 is formed and, correspondingly, engagement portions 7, 8 are disposed in the barrel 2 which engage with the lock portion 6 at the writing position and the housed position, respectively. The barrel 2 is held at the housed position by engaging the engagement portion 7 with the lock portion 6 and at the writing position by engaging the engagement portion 8 with the lock portion 6.

Figure 4:
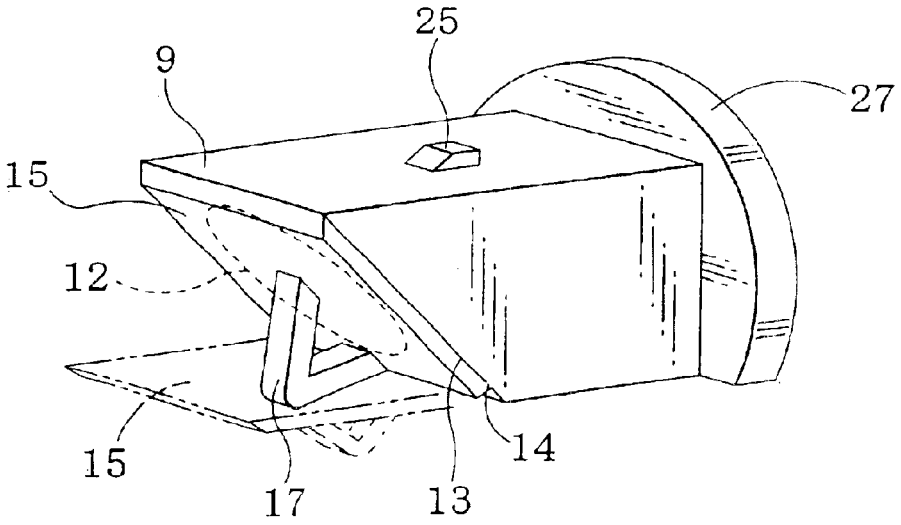
FIG. 4 is a perspective view of the airtight sleeve.

An airtight sleeve 9 is disposed in the barrel 2 so that it surrounds the writing tip 3. More specifically, the airtight sleeve 9 has an interior space defining an airtight chamber surrounding the writing tip 3 of the writing component 1 when the writing component is in the housed position. As shown in FIG. 4, the airtight sleeve 9 comprises a tubular member having a generally rectangular-shaped outer surface portion and a generally cylindrical-shaped inner surface portion. The airtight sleeve 9 is movable forward and backward between the advanced position and the retracted position in a predetermined range without rotation, and is fitted at a front portion of the writing component 1.

The airtight sleeve 9 has an inner raised portion 11 adapted to contact a shoulder 10 formed on the writing component 1 in an airtight manner. The airtight contact between the inner raised portion 11 of the airtight sleeve 9 and the shoulder 10 of the writing component 1 is designed to be releasable when the airtight sleeve 9 stops at the advanced position. More specifically, the airtight contact between these components is released when the airtight sleeve 9 stops at the advanced position by moving the barrel 2 in such a direction that the writing tip 3 of the writing component 1 protrudes outwardly from the aperture 4 of the barrel 2.

The airtight sleeve 9 has a bore 12 at a front end portion thereof through which the writing tip 3 of the writing component 1 passes. The front side of the bore 12 has a slanted opening edge 13 which slants at an oblique angle of at most about 60°, preferably about 45°, relative to the longitudinal axis of the barrel 2. The airtight sleeve 9 also has a cap plate 15 which is pivotally connected to a lower side edge of the airtight sleeve 9 at the bore 12 so that the bore 12 can be opened and closed via an integral plastic hinge 14 by pivotal movement of the cap plate 15. As shown in FIG. 4, the hinge 14 extends in the widthwise direction of the cap plate 15 and, as a result, the cap plate 15 is closely and securely contacted with the entire edge of the slanted opening edge 13.

A projecting rib 17 is disposed on a rear side of the cap plate 15 so that when the airtight sleeve 9 moves toward the retracted position, the projecting rib abuts on an inner side 16 of the barrel 2 to pivot the cap plate 15 about the hinge 14 and press the cap plate toward the slanted opening edge 13. The projecting rib 17 may be formed in any appropriate shape. In the embodiment shown in FIG. 4, the projecting rib 17 is generally triangular-shaped in cross-section with one end of the triangle being connected to a central portion of the cap plate 15. Furthermore, the projecting rib 17 may be formed with a solid or hollow body. If the projecting rib 17 is formed with a hollow body having an appropriate elasticity, as shown in FIG. 4, or formed by using an appropriate elastic piece, the cap plate 15 can be closely contacted to the slanted opening edge 13 with effective elasticity.

The barrel 2 has a window hole 18 through which the projecting rib 17 enters when the airtight sleeve 9 moves toward the advanced position. By this structure, when the cap plate 15 abuts on the writing tip 3 and is thereby pressed, the projecting rib 17 enters into the window hole 18 and the cap plate 15 is allowed to pivot and be released in a direction to open the bore 12.

Figure 3:
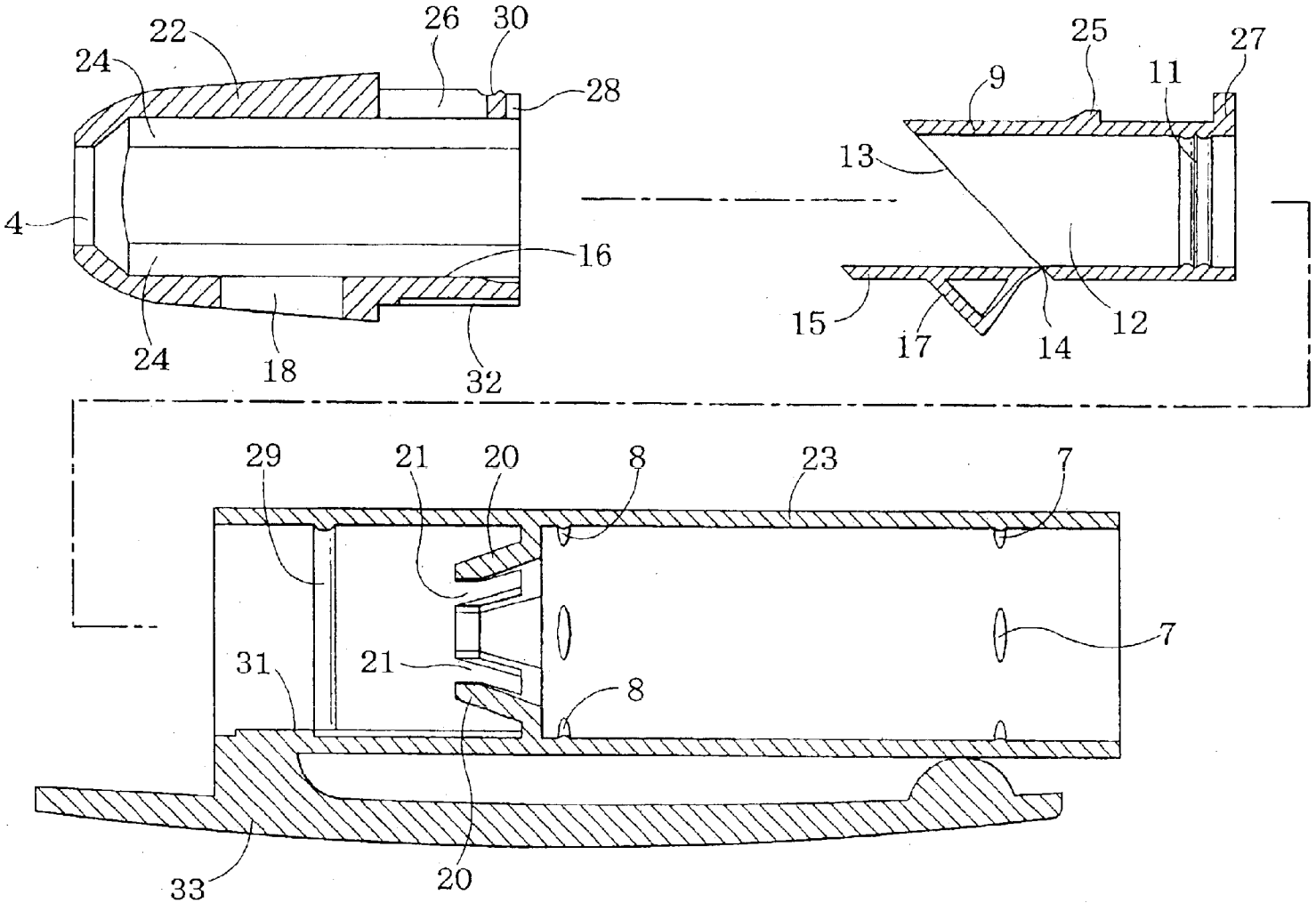
FIG. 3 is an exploded cross-sectional view of a barrel and an airtight sleeve of the writing instrument according to the present invention.

The writing component 1 has an intermediate portion 19 between the shoulder 10 and the large diameter portion 5. The intermediate portion 19 is held elastically by a holding member 20 of the barrel 2. As shown in FIG. 3, the holding member 20 is generally conical-shaped and has slits 21. When the shoulder 10 of the writing component 1 is pressingly inserted from the large diameter side and passed through it toward the small diameter side of the holding member 20, the barrel 2 can be installed so that it will not separate from the writing component 1. In the embodiment shown in FIG. 3, the holding member 20 is formed in one piece with the barrel 2. Alternatively, the holding member 20 may be a separate component which is integrally connected to the barrel 2.

Referring to FIGS. 1 and 3, the barrel 2 comprises a front piece 22, which has the aperture 4 and the window hole 18, and a barrel main body 23 connected to the front piece 22. The airtight sleeve 9 is attached to the front piece 22 of the barrel. A guide wall 24 is provided at an inner side of the front piece 22 to guide a side surface of the airtight sleeve 9. A guide groove 26 is formed on an the outer side of the front piece 22 for receiving a projection 25 extending from an outer surface of the airtight sleeve 9. A flange 27 of the airtight sleeve 9 is adapted to abut with a stop element or stopper 28 formed at a rear end portion of the front piece 22. A circumferential groove 30 is formed on the periphery of the front piece 22 for receiving a projection 29 of the barrel main body 23 to prevent detachment of the front piece 22 from the barrel main body 23. The front piece 22 also has a longitudinal groove 32 for receiving a projection 31 of the barrel main body 23 to prevent relative rotation between the front piece 22 and the barrel main body 23.

According to the present invention, the barrel main body 23 functions as a cap and also functions as a grip during a writing operation. In order to provide a comfortable grip during a writing operation, the barrel main body may have a multi-layer structure (not shown) wherein a basal portion is formed with a hard layer and the surface portion is formed with a soft layer by, e.g., two-color molding or an injection molding process. A clip 33 is disposed on the outside of the barrel main body 23.

Accordingly, as shown in FIG. 1, the barrel 2 is maintained at the housed position where the engagement portion 7 engages with the lock portion 6 of the writing component 1. Further, the writing tip 3 is housed in the airtight sleeve 9, the inner raised portion 11 is in contact with the shoulder 10, and the cap plate 15 is pressingly contacted to the slanted opening edge 13 by the projecting rib 17, whereby the inside of the airtight sleeve 9 is kept in an airtight condition and the writing tip 3 is prevented from drying.

Figure 5:
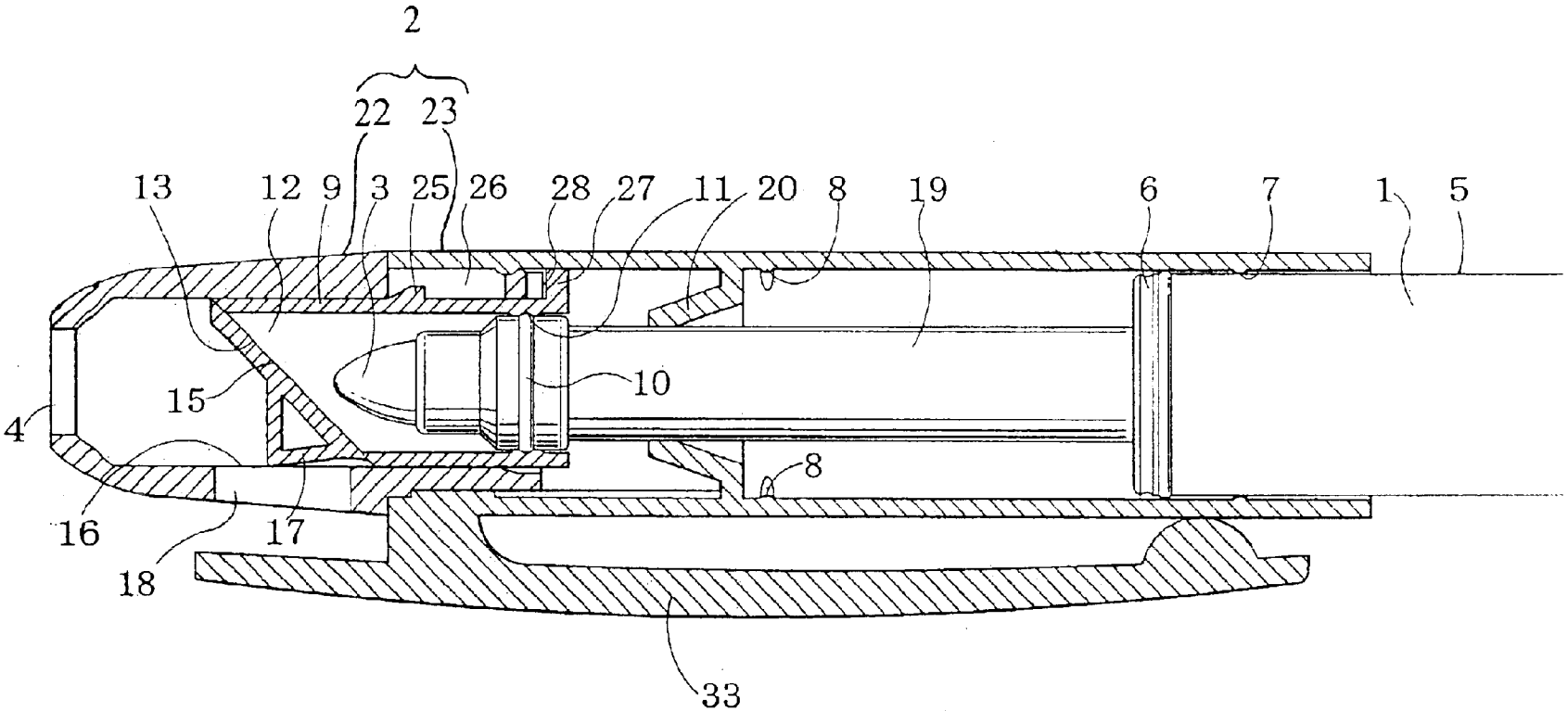
FIG. 5 is a partial cross-sectional view of the writing instrument of the present invention showing a state where the airtight sleeve is located at an advanced position.

From the state shown in FIG. 1, if the barrel 2 is moved toward the writing position (rightward in FIG. 1), the lock portion 6 and the engagement portion 7 are disengaged, but the inner raised portion 11 of the airtight sleeve 9 remains in contact with the shoulder 10, whereby the airtight sleeve 9 is maintained in a standstill condition where it is held by the writing component. Accordingly, relative to the barrel 2, the airtight sleeve 9 is seen as if it moves from the retracted position toward the advanced position (FIG. 5).

Figure 6:
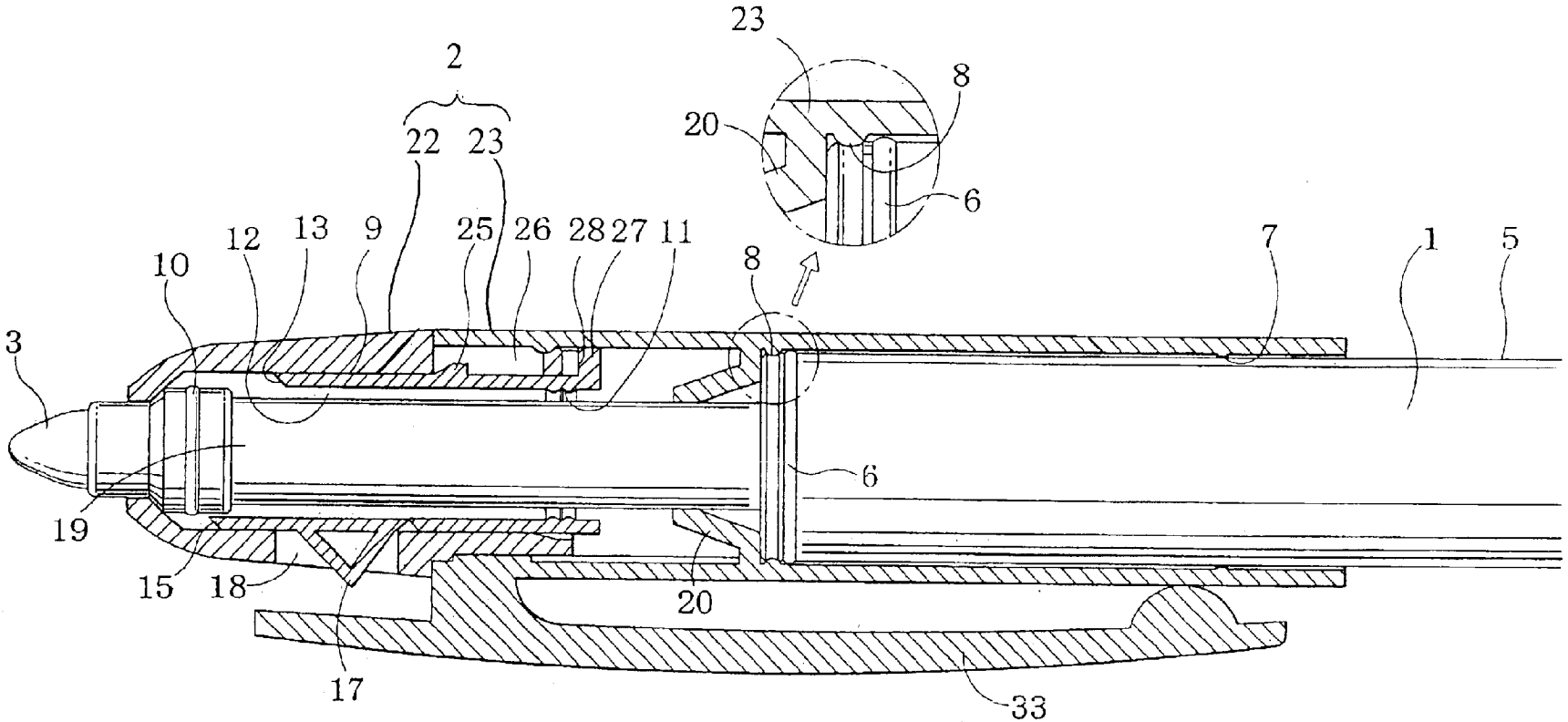
FIG. 6 is a partial cross-sectional view of the writing instrument of the present invention showing a state where a writing tip of the writing instruments protrudes from the barrel.

When the stopper 28 of the front piece 22 abuts on the flange 27 of the airtight sleeve 9, relative movement between the airtight sleeve 9 and the barrel 2 is inhibited. The airtight sleeve 9 exists at the advanced position in this state, and since the projecting rib 17 confronts the window hole 18, it projects through the window hole 18. Accordingly, by further moving the barrel 2, the cap plate 15 abuts on the writing tip 3, and the cap plate 15 is rotated and opens the bore 12 of the airtight sleeve. The writing tip 3 protrudes from the aperture 4 of the barrel and reaches the writing position (FIG. 6). At this time, since the engagement portion 8 of the barrel 2 engages with the lock portion 6 of the writing component 1, the barrel is maintained at the writing position, and the user can perform a writing operation by gripping the barrel main body 23. The engagement force at the lock portion 6 and the engagement portion 8 at this time is set to such a level that it can withstand the writing force.

Figure 7:
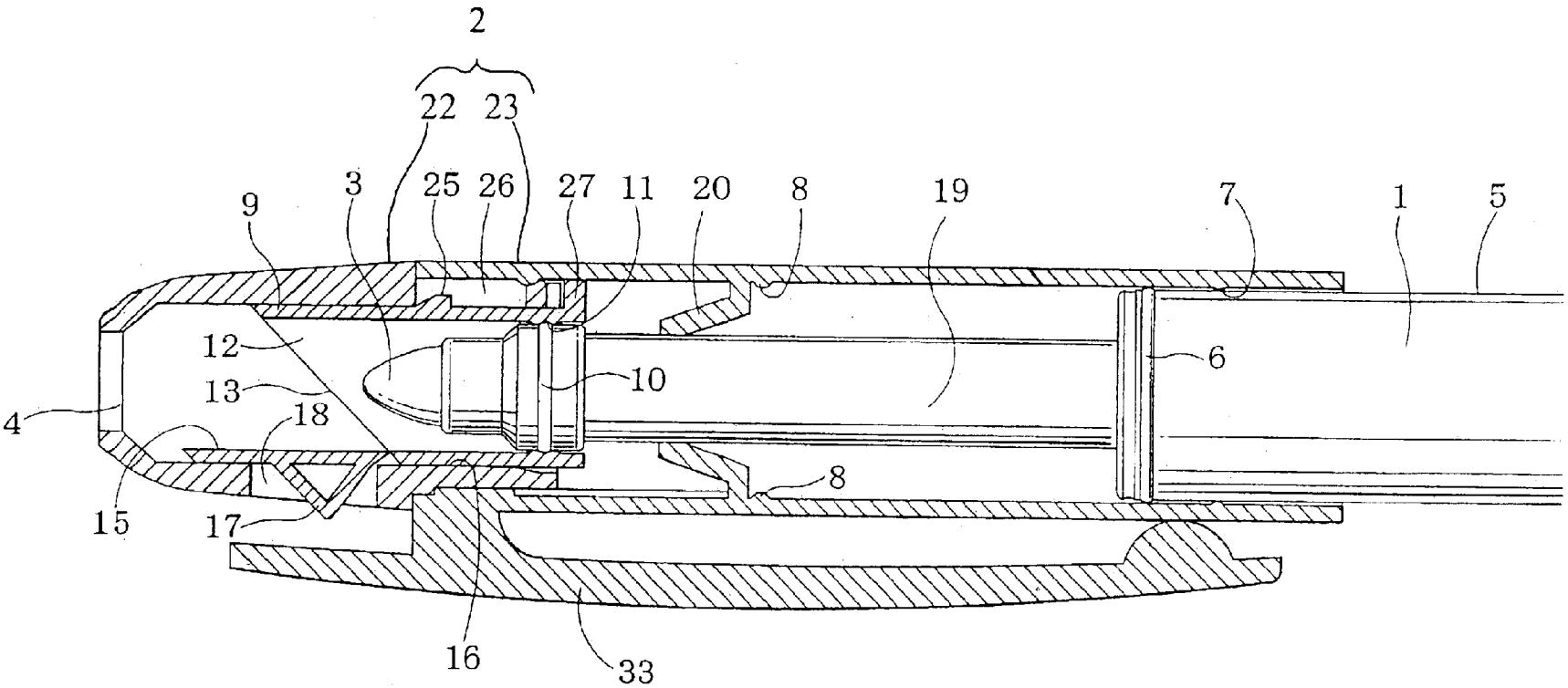
FIG. 7 is a partial cross-sectional view of the writing instrument of the present invention showing a cap plate of the airtight sleeve disposed in a window hole of the barrel.

When the barrel 2 is moved from the writing position as shown in FIG. 6 toward the housed position (leftward in FIG. 6), the lock portion 6 and the engagement portion 8 are disengaged by a force greater than the writing force, and the airtight sleeve 9 moves together with the barrel. During movement of the airtight sleeve 9, when the inner raised portion 11 of the airtight sleeve 9 contacts the shoulder 10 of the writing component 1, the movement of the airtight sleeve is stopped by the writing component (FIG. 7). When the barrel 2 is further moved, the airtight sleeve 9 is seen as if it moves toward the retracted position relative to the barrel. As a result, the airtight sleeve 9 abuts on the inner side 16 of the barrel 2, the projecting rib 17 comes out of the window hole 18 and is in slidable contact with the inner side 16, and the cap plate 15 is pressed toward the slanted opening edge 13 and, as shown in FIG. 1, the airtight sleeve reaches the retracted position and holds the writing component 1 at the housed position.

In the writing instrument as shown in FIG. 1, only by moving the barrel fitted to the front portion of the writing component backward along the axial direction, the cap plate of the airtight sleeve is opened, and the writing tip of the writing component can be protruded from the aperture of the barrel at the time of writing. Further, when the barrel is moved forward from the writing position, the cap plate is rotated by the projecting rib and closes the bore of the airtight sleeve, whereby the cap plate surrounds airtightly the periphery of the writing tip and prevent the writing tip from drying.

Since the cap plate is pressed against the slanted opening edge by the projecting rib, the pressing force can be transferred over the entire cap plate and the cap plate can be closely contacted to the opening edge securely and entirely. In addition, since the opening edge is slanted, the rotation of the cap plate can be made small as compared with the case where the opening edge is set at a right angle, and thus the stress exerted on the hinge is low and the durability is improved. Further, since no special means, such as a spring, is required to pressingly fit the cap plate, and the pressing force can always be imparted by means of the projecting rib, the overall structure of the writing instrument is simplified. Furthermore, since the number of parts of the writing instrument is reduced, it is possible to reduce the diameter of the barrel, assembly of the writing instrument is facilitated, and the writing instrument can be obtained economically.

FIGS. 8–14 show another embodiment of the writing instrument according to the present invention in which a writing component 101 is moved in the axial direction relative to a barrel 103.

Figure 8:
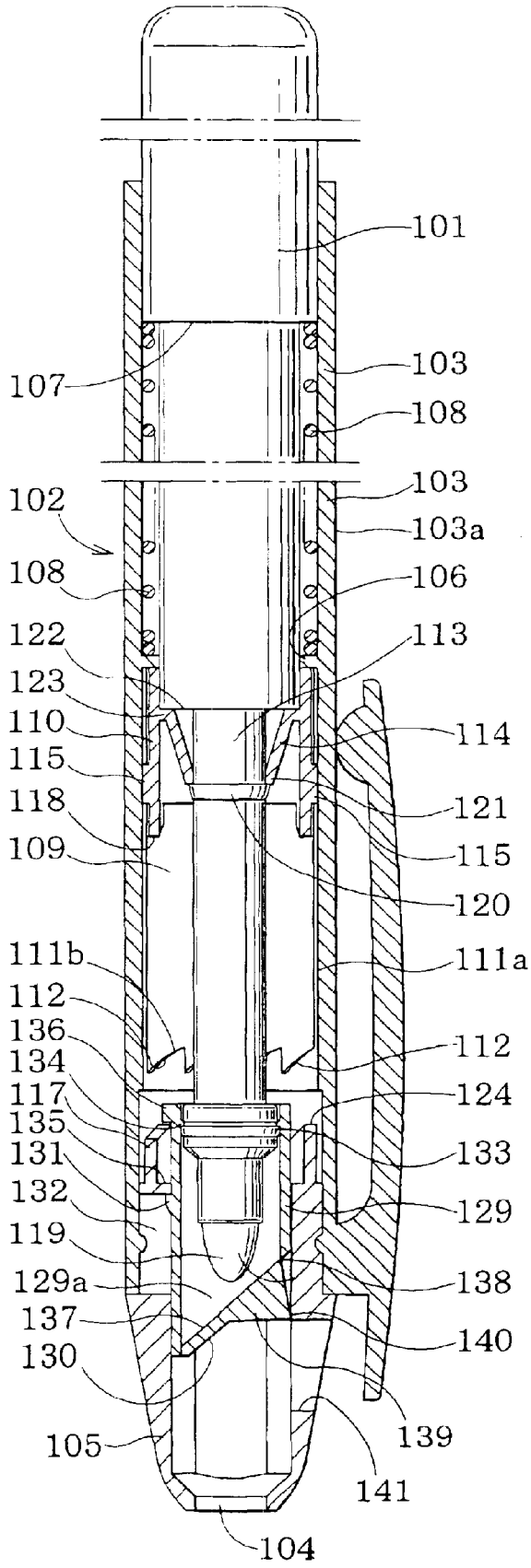
FIG. 8 is a partially cutaway view showing another embodiment of the writing instrument according to the present invention.

FIG. 8 is a partially cutaway view showing the writing instrument of the present invention, and shows a writing instrument 102 having a writing component 101 containing volatile writing constituents such as a marker, a water-based ink pen, a water-based ball point pen, a correction pen and a highlighter pen. The writing component 101 is housed in a barrel 103, and the barrel 103 includes a front piece 105 having a barrel main body 103*a* and an aperture 104 communicating to its front end.

Figure 9:
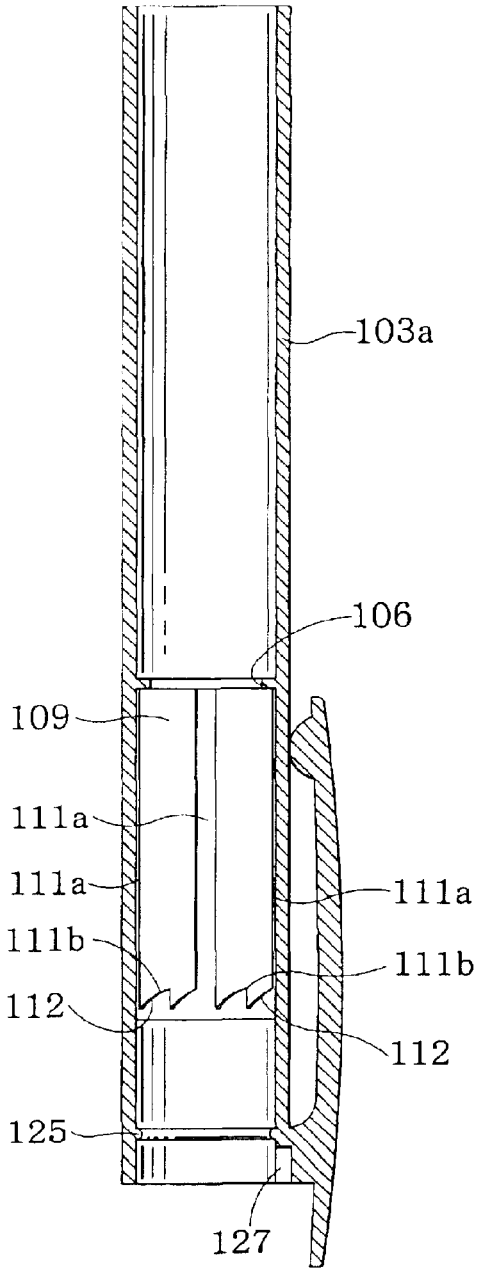
FIG. 9 is a cross-sectional view of a main barrel of the main body of the writing instrument of the present invention.

With reference to FIG. 8 and FIG. 9, an inward stepped portion 106 is formed in the barrel 103, and a spring 108 is provided between the inward stepped portion 106 and a stepped portion 107 of the writing component 101 so as to bias the writing component 101 backwardly. Ahead of the inward stepped portion 106, an outer cam 109 constituting a rotating cam-type feeding mechanism is formed. The outer cam 109 has, as conventionally known, a deep cam groove 111*a* and a shallow cam groove 111*b* which extend in the axial direction so as to guide the movement of a rotational cam 110 in the axial direction, and an angle-shaped cam element 112 disposed at a front end thereof for rotating the rotational cam 110. In the example shown in FIG. 8, the outer cam 109 is formed in one piece with an inner surface of the forward portion of the barrel 103. Alternatively, the outer cam 109 may be provided as a separate component in the form of a generally cylindrical-shaped body which is integrally connected to the barrel 103.

Figure 10:
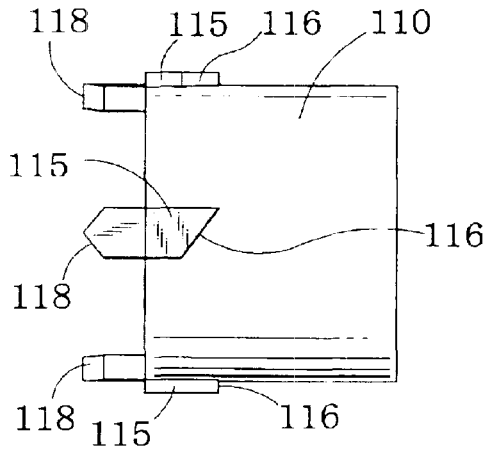
FIGS. 10(A)–10(C) are a front view, a side view and a cross-sectional view, respectively, of a rotational cam of the writing instrument according to the present invention.
Figure 10:
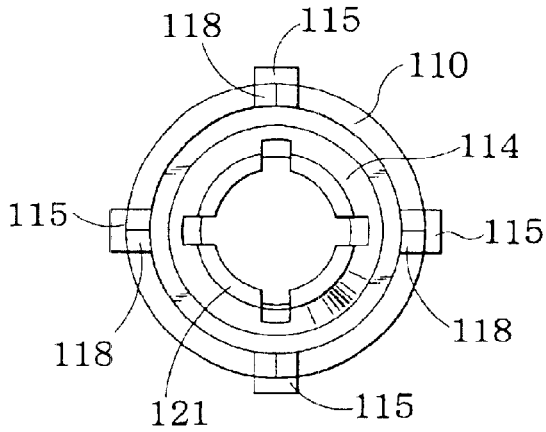
Figure 10:
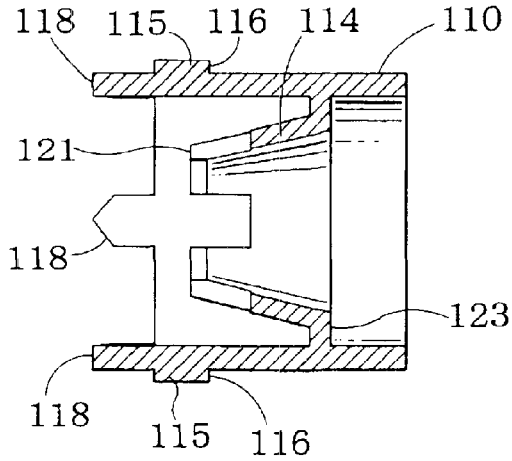

The rotational cam 110 is mounted in the barrel 103 for undergoing both rotation and axial movement therein, and is generally cylindrical-shaped with an outer diameter dimensioned to be inserted into the outer cam 109. The rotational cam 110 has, on the inner side, a connecting portion 114 which is fitted to a neck portion 113 of the writing component 101 (FIG. 10). A projection 115 is provided on the periphery of the rotational cam 110 for engagement with the cam grooves 111*a*, 111*b* of the outer cam 109. A slanted cam element 116 is provided at a rear end portion of the projection 115 for engagement with the cam element 112 of the outer cam 109. A cam element 118 for engagement with a guide cam 117 is provided at a forward end of the rotational cam 110.

The connecting portion 114 of the rotational cam 110 is elastic so that it can be enlarged so that it can be inserted from a writing tip 119 side to a neck portion 113 of the writing component 101, and when it is inserted up to the neck portion 113, a forward end 121 thereof engages with a flange 120 formed on the writing component 101 and its basal end 123 engages with an intermediate stepped portion 122. Here, the rotational cam 110 is loosely fitted to the writing component so that it can be rotated while keeping such a state that it is fitted to the writing component. The rotational cam 110 may be a separate component integrally connected to the writing component 101 or it may be formed unitarily with the writing component 101.

Figure 11:
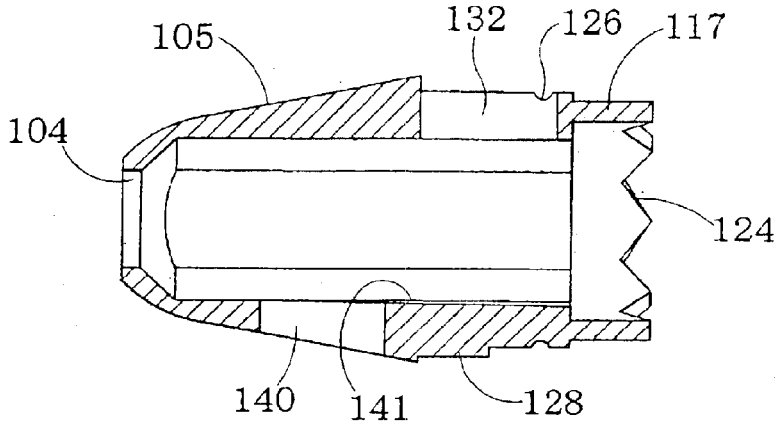
FIGS. 11(A) and 11(B) are a cross-sectional view and a side view, respectively, show a front piece of the writing instrument according to the present invention.
Figure 11:
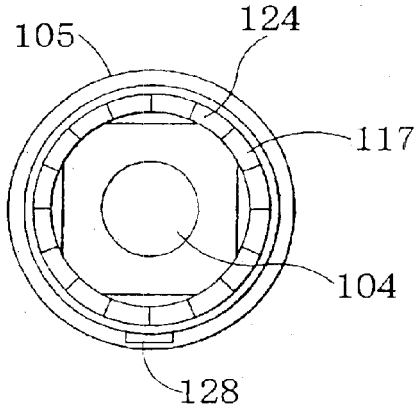

As shown in FIG. 11, the guide cam 117 is provided at the rear end of the front piece 105 ahead of the rotational cam 110 and has a cam element 124. When the projection 115 of the rotational cam 110 separates or disengages from the cam grooves 111*a*, 111*b* of the outer cam, the cam element 118 of the rotational cam 110 abuts on the cam element 124 to rotate the rotational cam 110. The cam element 124 confronts the cam element 112 of the outer cam 109 so as to rotate the rotational cam 110 by a predetermined angle. Accordingly, on the periphery of the front piece 105, a circumferential groove 126 (FIG. 11) is formed so that it engages with a latching projection 125 formed in the barrel main body (FIG. 9). Further, in order to engage with a longitudinal groove 127 which is formed on the barrel main body and extends in the axial direction, a projection 128 is provided so that the front piece 105 is connected to the barrel main body 103*a* in a non-rotatable state. The connection between the front piece 105 and the barrel main body 103*a* can be achieved by appropriate connecting means such as a press-fit connection, an adhesive, a latching pin or the like.

The rear end of the writing component 101 protrudes from the rear end of the barrel 103 at the housed position. The rear end of the barrel 103 may be extended rearwardly so that the rear end of the writing component can be housed in the extended portion of the barrel. In this case, in order to operate the writing component from the outside of the barrel, an appropriate operating member such as a push button or the like may be provided (not shown).

By the foregoing construction, when the rear end of the writing component 101 is directly knocked forwardly or the writing component is indirectly knocked forwardly via an appropriate operating member connected to the writing component (not shown), the projection 115 of the rotational cam 110 separates or disengages from the deep cam groove 111*a* of the outer cam 109 and abuts on the guide cam 117 to rotate the rotational cam. When the knocking is stopped, the writing component 101 retracts a little by the spring 108, and the projection 115 engages with the shallow cam groove 111*b* of the outer cam 109. Accordingly, the writing component 101 is maintained at the writing position in such a state that the writing tip 119 protrudes from the aperture 104. When the writing component 101 is knocked again, the rotational cam 110 abuts on the guide cam 117 and thus further rotates, and when the knocking is stopped, the projection 115 engages with the deep cam groove 111*a* of the outer cam 109. The writing component 101 thereby retracts substantially and is held at the housed position.

In the front piece 105, an airtight sleeve 129 is provided which is fitted to the front portion of the writing component 101 so that it surrounds the writing tip 119 of the writing component. The airtight sleeve 129 has a cap plate 130 at its front portion, and when the writing component 101 moves to the writing position, the cap plate 130 is opened and the writing component 119 protrudes from the front end of the barrel. Further, when the writing component moves to the housed position, the cap plate 130 is closed and the writing tip 119 is airtightly held.

The airtight sleeve 129 has substantially the same function as the airtight sleeve 9 described above with respect to the embodiment of FIGS. 1–7. More specifically, the airtight sleeve 129 is disposed at the front portion of the writing component 101 for undergoing forward and rearward movement in a non-rotatable manner so that when the writing component moves to the writing position, the airtight sleeve 129 moves to the advanced position and the cap plate 130 is opened, and when the writing component 101 moves to the housed position, the airtight sleeve 129 moves to the retracted position and the cap plate 130 is closed.

Figure 12:
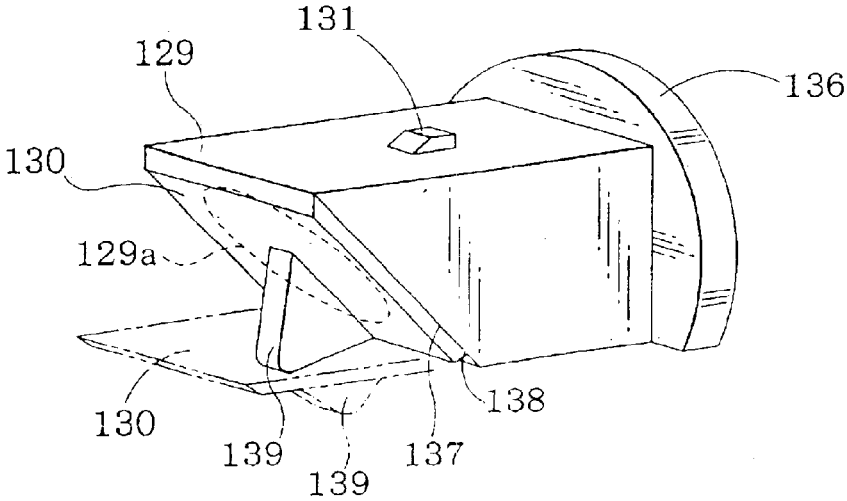
FIG. 12 is a perspective view of the airtight sleeve of the writing instrument according to the present invention.
Figure 13:
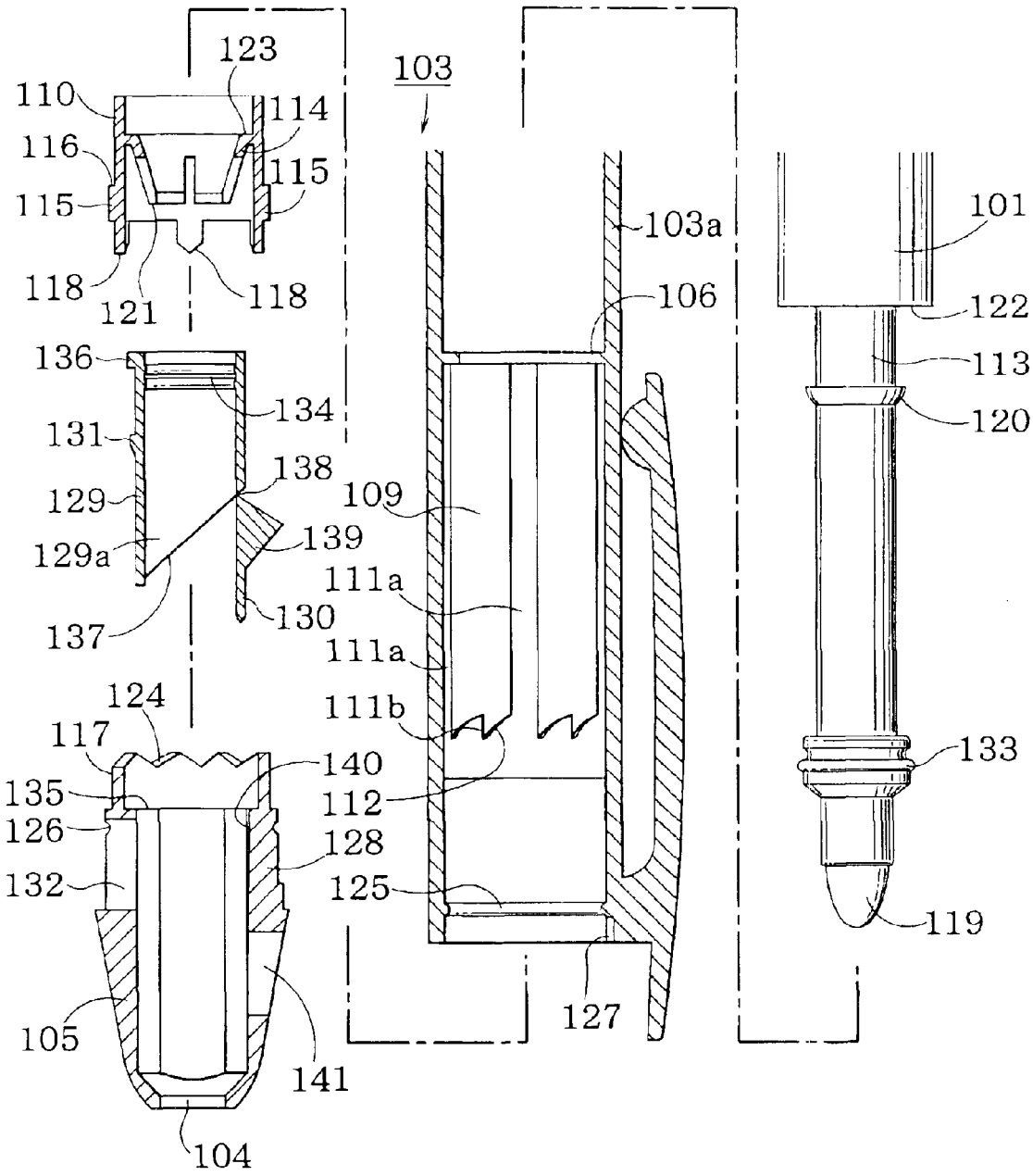
FIG. 13 is an exploded partial cross-sectional view of a barrel main body, a rotational cam, an airtight sleeve and a front piece of a writing instrument according to the present invention.
Figures 14A, 14B, 14C:
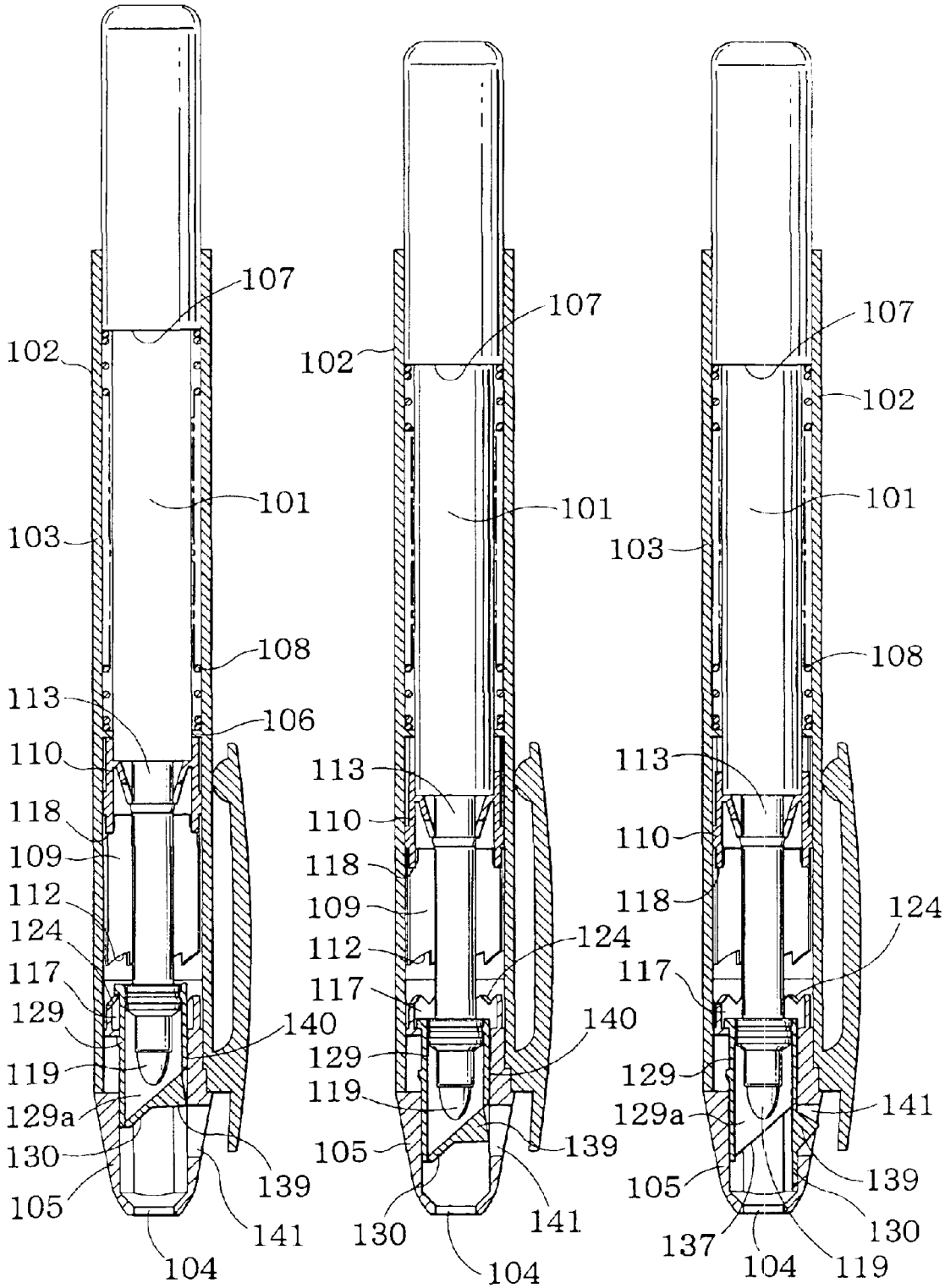
FIGS. 14(A)–14(C) are explanatory views of movement states of components of the writing instrument according to the present invention where

With reference to FIG. 12 and FIG. 13, the airtight sleeve 129 is made of a plastic material and is inserted into the front piece 105 for undergoing forward and rearward movement in such a state that a projection 131 disposed on the outer side is inserted into a guide groove 132 of the front piece 105. The airtight sleeve 129 has an inner raised portion 134 which extends from an inner surface thereof and is engageable with a shoulder 133 formed on the writing component 101. The inner raised portion 134 engages with the shoulder 133 in an airtight manner when the writing component 101 is located at the housed position (FIG. 14(A)). Thus the airtight sleeve 129 moves together with the movement of the writing component 101 when the writing component moves toward the writing position. At the rear end of the airtight sleeve 129, a flange 136 is disposed so that it abuts on a stopper 135 formed on the inner side of the front piece 105. Accordingly, when the airtight sleeve 129 advances up to the position where the flange 136 abuts on the stopper 135 as shown in FIG. 14(B), the airtight sleeve 129 stops at this position and is held at the advanced position. When the writing component further advances, the engagement between the inner raised portion 134 and the shoulder 133 is disengaged, and only the writing component advances.

The cap plate 130 is pivotably provided by an integrally formed hinge 138 at the basal end of a slanted opening edge 137, and at its rear side, a solid projecting rib 139 is formed. To the front piece 105, a sliding surface 140 on which the projecting rib 139 slides and a window hole 141 in which the projecting rib 139 enters, are provided. When the airtight sleeve 129 is located at the retracted position, the projecting rib 139 slidably contacts the sliding surface 140 and presses the cap plate 130 against the slanted opening edge 137, thereby closing a bore 129*a* of the airtight sleeve (FIG. 14(A)).

Figure 15A:
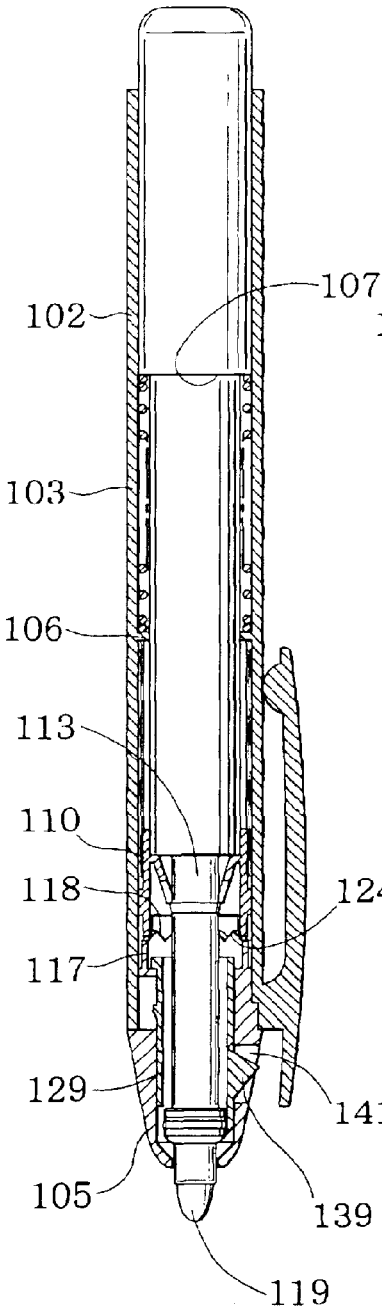
FIGS. 15(A)–15(C) are explanatory views of movement states of components of the writing instrument according to the present invention where
Figure 15B:
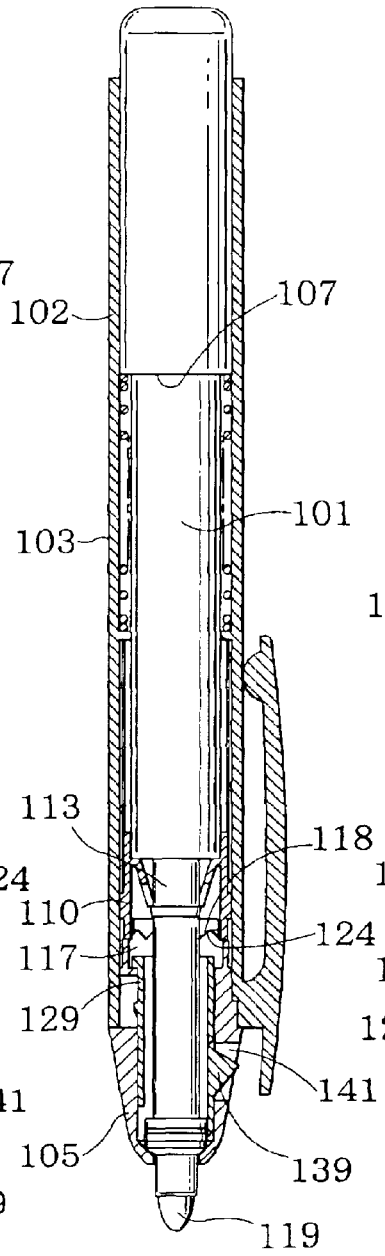
Figure 15C:
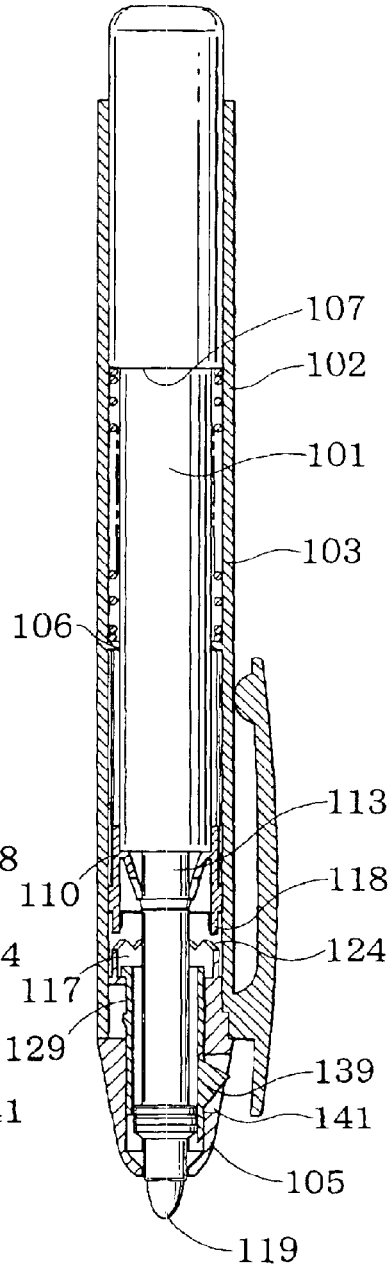

As described above, when the airtight sleeve 129 moves up to the advanced position, the projecting rib 139 projects into the window hole 141 and the cap plate 130 rotates (FIG. 14(C)), whereby it becomes possible to open the bore of the airtight sleeve 129 to allow the writing tip 119 of the writing component 101 to protrude outwardly from the aperture 104 of the front piece 105 (FIG. 15(A)). When the rotational cam 110 rotates as described above (FIG. 15(B)) to hold the writing instrument 101 at the writing portion, a writing operation can be conducted as shown in (FIG. 15(C)).

When the writing component 101 is knocked to retract it from the writing position to the housed position, the shoulder 133 engages with the inner raised portion 134 during movement (FIG. 14(C)) and the airtight sleeve 129 returns from the advanced position to the retracted position together with movement of the writing component 101. At this time, the projecting rib 139 disengages from the window hole 141 and slides on the sliding surface 140 (FIG. 14(B)), and the cap plate 130 is rotated by the projecting rib 139 and is thereby pressed against the slanted opening edge 137, whereby the writing tip 119 is airtightly held (FIG. 14(A)). When the shoulder 133 and the inner raised portion 134 of the airtight sleeve 129 are closely contacted with one another with a strong contact force, the airtight property is enhanced. Accordingly, for example, a spring (not shown) may be provided between the flange 120 of the writing component 101 and the rear end of the airtight sleeve 129 to bias the airtight sleeve 129 forward.

By the foregoing construction of the writing instrument 102, since the guide cam which imparts rotation to the rotational cam is integrally formed at the rear portion of the front piece, the number of parts constituting the rotating cam-type feeding mechanism is reduced, thereby providing a writing instrument having a simple construction. Furthermore, since the rotating cam-type feeding mechanism is incorporated into the front portion of the barrel, even if a long writing component is used and incorporated together with the airtight sleeve, the entire writing instrument can be made compact and can be used for a long time since the writing component can be maintained in an airtight condition when it is not used.

From the foregoing description, it can be seen that the present invention comprises an improved writing instrument. It will be appreciated by those skilled in the art that obvious changes and variations can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

We claim:

1. A writing instrument comprising: a tubular member having a longitudinal axis and an aperture at an end thereof; a writing component mounted in the tubular member and having a writing tip at an end portion thereof, the tubular member and the writing component being movable relative to one another in an axial direction along the longitudinal axis of the tubular member between a writing position at which the writing tip protrudes from the aperture of the tubular member and a housed position at which the writing tip is disposed in the tubular member; an airtight sleeve connected to the end portion of the writing component for movement between an advanced position and a retracted position, the airtight sleeve having a bore through which the end portion of the writing component passes during movement of the writing component between the writing position and the housed position; a cap plate pivotally connected to the airtight sleeve for opening and closing the bore of the airtight sleeve; and a projecting rib connected to the cap plate so that when the airtight sleeve moves from the advanced position to the retracted position, the projecting rib abuts an inner surface of the tubular member so as to pivot the cap plate in such a direction that the cap plate closes the bore of the airtight sleeve; wherein the tubular member has a window hole into which the projecting rib projects when the airtight sleeve moves from the retracted position to the advanced position to allow the cap plate to pivot in a direction to open the bore of the airtight sleeve.

2. A writing instrument according to claim 1; wherein the writing component has a shoulder located behind the writing tip; and wherein the airtight sleeve has an inner raised portion for engaging with the shoulder of the writing component with an airtight contact when the airtight sleeve is located at the retracted position and for disengaging from the shoulder of the writing component when the airtight sleeve is located at the advanced position.

3. A writing instrument according to claim 1; wherein an edge of the airtight sleeve proximate the bore thereof is disposed at an oblique angle relative to a longitudinal axis of the tubular member.

4. A writing instrument according to claim 1; wherein the airtight sleeve has a flange disposed at a rear portion thereof; and wherein the tubular member has a stop element for engaging the flange of the airtight sleeve to limit movement of the airtight sleeve from the retracted position to the advanced position.

5. A writing instrument according to claim 4; wherein the airtight sleeve has a generally rectangular-shaped portion connected to the flange.

6. A writing instrument according to claim 1; wherein the tubular member has a main body and a front piece connected to the main body; and wherein the airtight sleeve is disposed in the front piece of the tubular member.

7. A writing instrument according to claim 1; further comprising a rotating cam-type feeding mechanism disposed in the tubular member for moving the writing component in the axial direction.

8. A writing instrument according to claim 7; wherein the tubular member has a main body and a front piece connected to the main body; and wherein the airtight sleeve is disposed in the front piece of the tubular member.

9. A writing instrument according to claim 8; wherein the rotating cam-type feeding mechanism comprises a rotational cam connected to the writing component for undergoing rotational movement and movement in the axial direction, an outer cam having a cam groove for guiding movement of the rotational cam in the axial direction, and a guide cam connected to a rear end of the front piece of the tubular member and having a cam element for rotating the rotational cam.

10. A writing instrument according to claim 8; wherein the airtight sleeve has a flange disposed at a rear portion thereof; and wherein the tubular member has a stop element disposed at a rear portion of the front piece for engaging the flange of the airtight sleeve to limit movement of the airtight sleeve from the retracted position to the advanced position.

11. A writing instrument according to claim 1; further comprising a cap plate pivotally connected to the airtight sleeve for opening and closing the bore of the airtight sleeve, and a generally triangular-shaped projecting rib connected to a central portion of the cap plate so that when the airtight sleeve moves from the advanced position to the retracted position, the projecting rib abuts an inner surface of the tubular member so as to pivot the cap plate in such a direction that the cap plate is pressed against and closes the bore of the airtight sleeve.

12. A writing instrument according to claim 1; further comprising a cap plate pivotally connected to the airtight sleeve for opening and closing the bore of the airtight sleeve, and an elastic projecting rib connected to the cap plate so that when the airtight sleeve moves from the advanced position to the retracted position, the projecting rib abuts an inner surface of the tubular member so as to pivot the cap plate in such a direction that the cap plate is pressed against and closes the bore of the airtight sleeve.

13. A writing instrument comprising: a tubular member comprised of a main body having a longitudinal axis and an aperture at an end thereof and a front piece connected to the main body; a writing component mounted in the tubular member and having a writing tip at an end portion thereof and a lock portion, the tubular member and the writing component being movable relative to one another in an axial direction along the longitudinal axis of the tubular member between a writing position at which the writing tip protrudes from the aperture of the tubular member and a housed position at which the writing tip is disposed in the tubular member, and the main body of the tubular member having a plurality of engagement portions each for respective engagement with the lock portion of the writing component at the writing position and at the housed position of the writing component; and an airtight sleeve disposed in the front piece of the tubular member and connected to the end portion of the writing component for movement between an advanced position and a retracted position, the airtight sleeve having a bore through which the end portion of the writing component passes during movement of the writing component between the writing position and the housed position.

14. A writing instrument according to claim 13; further comprising a holding member disposed in the main body of the tubular member for elastically supporting the writing component.

15. A writing instrument according to claim 13; wherein the airtight sleeve has a flange disposed at a rear portion thereof; and wherein the tubular member has a stop element disposed at a rear portion of the front piece for engaging the flange of the airtight sleeve to limit movement of the airtight sleeve from the retracted position to the advanced position.

16. A writing instrument comprising: a tubular member comprised of a main body having a longitudinal axis and an aperture at an end thereof and a front piece connected to the main body; a writing component mounted in the tubular member and having a writing tip at an end portion thereof, the tubular member and the writing component being movable relative to one another in an axial direction along the longitudinal axis of the tubular member between a writing position at which the writing tip protrudes from the aperture of the tubular member and a housed position at which the writing tip is disposed in the tubular member; and an airtight sleeve disposed in the front piece of the tubular member and connected to the end portion of the writing component for movement between an advanced position and a retracted position, the airtight sleeve having a bore through which the end portion of the writing component passes during movement of the writing component between the writing position and the housed position and having a projection, and the front piece of the tubular member having a guide groove extending in the axial direction for receiving the projection of the airtight sleeve.

17. A writing instrument comprising: a tubular member comprised of a main body having a longitudinal axis and an aperture at an end thereof and a front piece connected to the main body; a writing component mounted in the tubular member and having a writing tip at an end portion thereof, the tubular member and the writing component being movable relative to one another in an axial direction along the longitudinal axis of the tubular member between a writing position at which the writing tip protrudes from the aperture of the tubular member and a housed position at which the writing tip is disposed in the tubular member; a rotating cam-type feeding mechanism disposed in the tubular member for moving the writing component in the axial direction; and an airtight sleeve disposed in the front piece of the tubular member and connected to the end portion of the writing component for movement between an advanced position and a retracted position, the airtight sleeve having a bore through which the end portion of the writing component passes during movement of the writing component between the writing position and the housed position and having a projection, and the front piece of the tubular member having a guide groove extending in the axial direction for receiving the projection of the airtight sleeve.

18. A writing instrument comprising: a tubular member having a longitudinal axis and an aperture at an end thereof;

a writing component having a writing tip and mounted in the tubular member for undergoing movement therein in a direction along the longitudinal axis between a writing position at which the writing tip protrudes from the aperture of the tubular member and a housed position at which the writing tip is disposed in the tubular member; and an airtight sleeve disposed in the tubular member for undergoing movement between an advanced position and a retracted position during movement of the writing component between the writing and housed positions, respectively, the airtight sleeve having an interior space defining an airtight chamber surrounding the writing tip of the writing component when the writing component is in the housed position, a bore through which the writing tip of the writing component passes during movement of the writing component between the writing position and the housed position, a hinged plate for undergoing pivotal movement to open and close the bore of the airtight sleeve, and a projecting rib connected to the hinged plate so that when the airtight sleeve moves from the advanced position to the retracted position, the projecting rib abuts an inner surface of the tubular member so as to pivot the hinged plate in such a direction that the hinged plate closes the bore of the airtight sleeve; wherein the tubular member has a window hole into which the projecting rib projects when the airtight sleeve moves from the retracted position to the advanced position to allow the hinged plate to pivot in a direction to open the bore of the airtight sleeve.

19. A writing instrument according to claim 18; wherein the writing component has a shoulder located behind the writing tip; and wherein the airtight sleeve has an inner raised portion for engaging the shoulder of the writing component with an airtight contact when the airtight sleeve is located at the retracted position and for disengaging the shoulder of the writing component when the airtight sleeve is located at the advanced position.

* * * * *